United States Patent [19]

Yuhl, Jr.

[11] Patent Number: 4,565,308

[45] Date of Patent: Jan. 21, 1986

[54] CHILD RESISTANT POWDER DISPENSER

[75] Inventor: Edward J. Yuhl, Jr., Union, N.J.

[73] Assignee: Sterling Drug Inc., New York, N.Y.

[21] Appl. No.: 528,499

[22] Filed: Sep. 1, 1983

[51] Int. Cl.[4] ..... B65D 37/00

[52] U.S. Cl. ..... 222/632; 222/213; 222/496; 222/518; 222/153; 239/533.13; 239/602

[58] Field of Search ..... 222/153, 491, 494, 496, 222/497, 498, 518, 547, 213, 632, 633; 239/533.13, 533.14, 602; 137/543.19, 543.23, 535

[56] References Cited

U.S. PATENT DOCUMENTS

| | | | |
|---|---|---|---|
| 1,862,794 | 6/1932 | Lamb . | |
| 1,922,204 | 8/1933 | Johnson . | |
| 1,951,510 | 3/1934 | Goldberger | 222/491 |
| 1,965,812 | 7/1934 | Skippee | 222/494 |
| 1,982,294 | 11/1934 | Johnson . | |
| 2,040,638 | 5/1936 | Beck | 222/494 |
| 2,140,247 | 12/1938 | Pazdernick | 222/496 |
| 2,249,796 | 7/1941 | Thoms | 137/535 |
| 3,197,091 | 7/1965 | Millard . | |
| 3,206,079 | 9/1965 | Mancuji | 222/494 |
| 3,618,825 | 11/1971 | Clarke . | |
| 3,874,563 | 4/1975 | Schwartzman . | |
| 4,356,935 | 11/1982 | Kamin | 222/153 |

*Primary Examiner*—H. Grant Skaggs

*Attorney, Agent, or Firm*—William G. Webb; B. Woodrow Wyatt; Paul E. Dupont

[57] ABSTRACT

This invention relates to powder dispensers of the squeeze bottle type which are so constructed that a small child would be unable to manipulate the dispensing action and would thus be protected from ingestion or inhalation of the dispenser contents.

18 Claims, 4 Drawing Figures

CHILD RESISTANT POWDER DISPENSER

BACKGROUND

This invention relates to the field of squeeze type powder dispensers. More specifically, the invention relates to powder dispensers of the typed used for dispensing baby powders which must be so constructed that they could not be used by small children and thus would be characterized as child resistant.

Baby powder dispensers have conventionally been fabricated either of stamped metal, in which case they function by shaking the powder contents through openings in the top, or of flexible plastic, in which case they function by squeezing the sides of the container to force powder through openings in the top.

Even though baby powders, which are typically composed mainly of talcum powder, which itself is not toxic, are not generally regarded as a hazard from ingestion, they can cause serious problems to an infant who inadvertently inhales the material. Moreover, many baby powders sold commerically today are medicated, and these medications, if ingested or inhaled, can also produce serious consequences to a child. Thus there is a great need for child resistant baby powder dispensers, but the prior art has failed entirely to even address the problem.

INFORMATION DISCLOSURE STATEMENT

Thus Lamb U.S. Pat. No. 1,862,794 discloses a closure for a collapsible tube type container which is fitted with a screw-on closure head. The closure head has a spring biased plug 15 which fits within an exit port 11 of the tube and serves to close the port when the tube is not compressed. A second closure plug 14 is likewise spring biased upward and closes off discharges port 12 on the outer end of the closure unit when the tube is uncompressed. The spring which biases closure plugs 14/15 towards respective ports 12/11 is so constructed that when the tube is compressed, the two plugs are forced towards one another so as to open the two ports.

Johnson U.S. Pat. No. 1,922,204 discloses a dispensing closure for tubular collapsible containers, such as tooth paste tubes, which is designed to automatically close off the dispenser opening when the tube is not being squeezed. This is accomplished by providing a conical plug 10 which is connected via an elastic stem 10*a* to a retaining head 10*b* which is held in position by a retaining plate 11.

A variation of the Johnson concept for sealing a collapsible tube dispenser is described in Griffin U.S. Pat. No. 1,982,294. In the Griffin invention, a valve C, having a depending stem D, is biased downwards by a spring acting against the underside of a washer E and an enlarged bulb on the end of the stem. As with the Johnson dispenser, squeezing the tube causes opening of the valve against the force of the spring bias, allowing extrusion of the tube contents through the tubular nozzle. When pressure on the tube is relaxed, the valve recedes in the tube opening.

Millard U.S. Pat. No. 3,197,091 discloses a powder dispensing bottle which is fitted with a hollow cylindrical member slidably and rotatably mounted in the closure of the bottle. To dispense a metered amount of powder from the bottle, the cylindrical member is pushed downward to its fully retracted position, the bottle is inverted, thus filling the hollow section of the cylindrical member with the container contents, and the cylindrical member is then pulled outward to its fully extended position thus allowing the contents of the hollow section to fall out through an elongated side slot.

Clarke U.S. Pat. No. 3,618,825 discloses a squeeze type dispenser for liquids and semi-liquids. The neck of the closure for the dispenser is fitted with a spider like element 11 having a central knob 12. Over the spider like element is a flexible diaphragm 16 with a central hole 16′ which fits over, and is sealed by, the central knob 12 of the spider. Thus when the bottle is squeezed, the material is squeezed out of the nozzle, through openings in the spider, and, by outward flexing of the diaphragm, through the central hole 16′ in the diaphragm.

Schwartzman U.S. Pat. No. 3,874,563 discloses a fluid applicator for squeeze bottles which is fitted with a closure having a central truncated conical valve head 22 with a hollow valve stem 26. The bottom of the valve stem is joined via helical coil springs to a mounting ring 34. A disc valve assembly 42 is joined to the central opening of the valve head and serves a dual purpose: (1) to control the flow of liquid out of the hollow center of the valve stem and (2) to act as an air bleeder for admission of air to the container when squeezing pressure on the container is relaxed. Thus when the bottle is squeezed, the valve head/valve stem/disc valve assembly is forced upward against the bias of the helical springs, and liquid is forced out past the conical faces of the valve head and valve seat 18. When pressure is released, the valve head is returned to its closed position, and air is drawn into the container through holes 46 in the flexible disc valve thus equalizing the internal pressure.

Thus it will be seen that none of the Lamb, Johnson, Griffin, Millard, Clarke and Schwartzman disclosures even addresses the problem of child resistance, and, with the exception of Millard, they all describe closures which are not adaptable to dispensing of powders. The Millard closure clearly has no child resistance potential whatever.

BRIEF DESCRIPTION OF THE INVENTION

The dispensers of the present invention overcome the problem, which has not been addressed by the prior art, of providing baby powder dispensers of such design that a small child would be unable to operate the dispenser.

More specifically, the present invention is directed to a powder dispenser of the squeeze bottle type which comprises a flexible container, typically made of plastic, which is fitted with a dispenser closure cap, the central dispensing opening of which is closed by a valve of inverted conical shape. The valve is maintained within the central opening by an overcap and is biased downwards to effect sealing of the central dispenser opening by flexible retention means integral with the overcap. When the container is squeezed, the resulting increased internal pressure forces the conical valve upwards to allow ejection of powder from the central dispenser opening around the periphery of the valve, and when pressure on the bottle is released, the downward bias on the valve by the flexible retention means effects sealing engagement of the valve with the central opening. The bottle and the closure cap are of such construction and design that the force required to dispense the powder contents would be beyond the physical strength and dexterity of a child.

BRIEF DESCRIPTION OF THE DRAWINGS

The invention will now be described below with reference to the accompanying drawings wherein.

DETAILED DESCRIPTION OF THE INVENTION

The invention will now be described in detail with reference to the foregoing drawings wherein like numerals are used to identify like parts.

Figure 1:
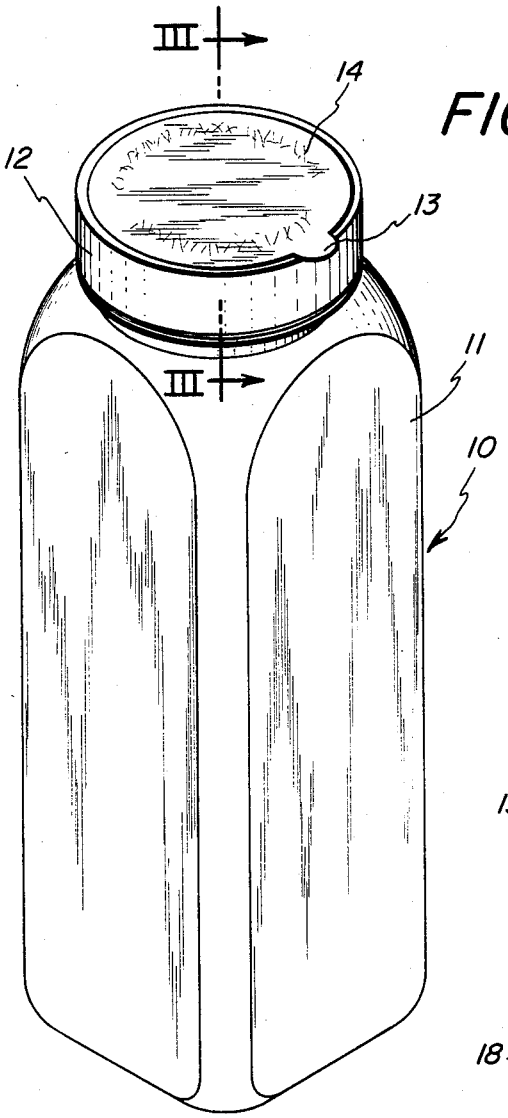
FIG. 1 is a perspective view of a squeeze type powder dispensing container of the type used with the dispensing closure of the invention.

With reference to FIG. 1, as stated before, the dispenser of the present invention comprises a squeeze type bottle 11, with an associated dispensing closure, the complete assembly being represented by general reference numeral 10. The closure cap 12 of the bottle, as the bottle would be packaged by the manufacturer and as received by the consumer, would optionally be sealed by a peel-off sealing membrane 13 on which could be included printed matter 14 either to identify the product and its manufacturer or to provide instructions for opening and use.

Figure 2:
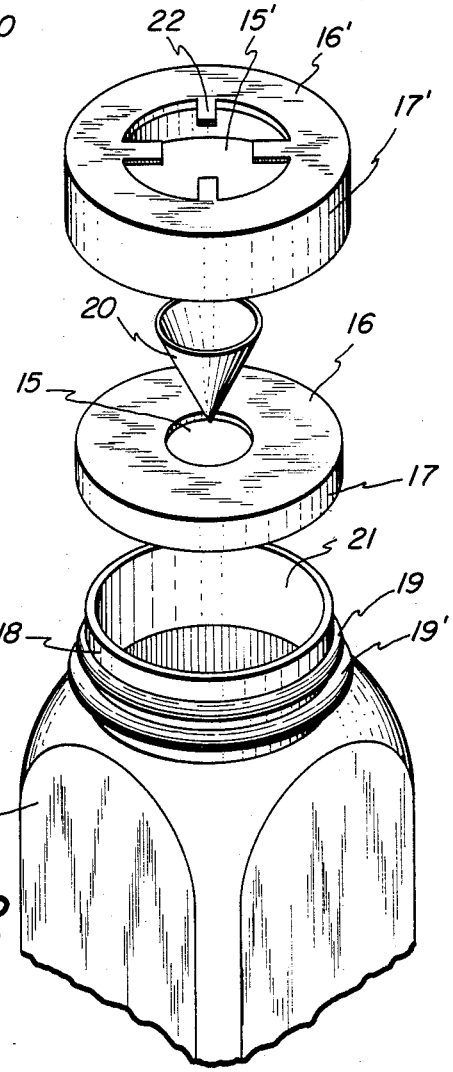
FIG. 2 is an exploded partial perspective view showing the top of the dispenser bottle and the associated elements of the dispensing closure of the invention.

The parts comprising the entire assembly of the bottle and closure are best seen with reference to FIG. 2. The dispensing closure, it will be seen, comprises at most only three parts, namely an inner cap having a central opening 15 therethrough, the inner cap being composed of a planar section 16 which is unitary with an annular skirt 17. When the inner cap is assembled onto the bottle, the skirt fits over a constricted neck portion 18 of the bottle, the bottom edge or rim of the skirt abutting annular ledge 19 at the base of the constricted neck portion.

An inverted conical valve element 20 fits within the central opening 15 of the inner cap, the diameter of the base of the conical valve being slightly larger than the diameter of the central opening so that the conical valve depends within the mouth 21 of the bottle and makes sealing engagement between the outer wall of the conical valve near the base thereof and the edge of the central opening.

The inner cap and the valve element are held securely in place on the mouth of the bottle by the closure cap 12 which also functions as an overcap. The latter, like the inner cap, also has a planar section 16', a depending annular skirt 17' and a central opening 15'. The overcap is also equipped with flexible tabs 22 which extend radially into the central opening 15' and are so dimensioned that they overlie the rim of the inverted conical valve element when the entire dispensing element is assembled on the bottle.

Figure 3A:
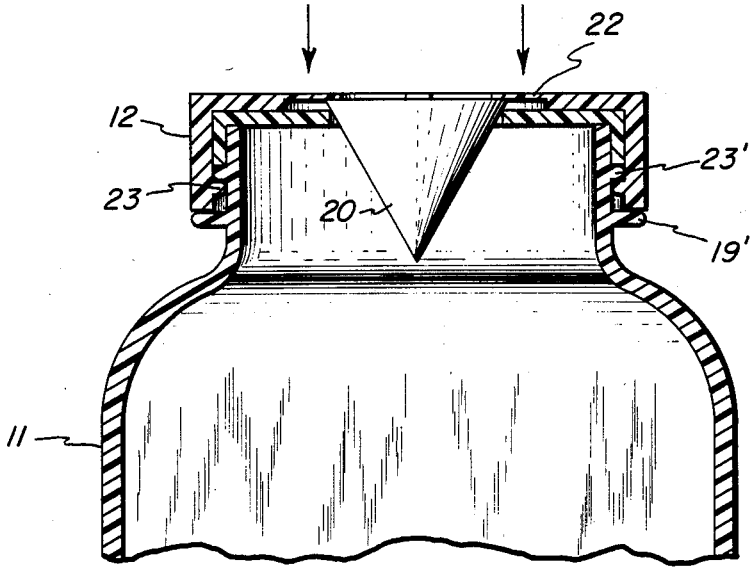
FIG. 3A is a cross section view on line III/III of FIG. 1, but lacking the peel-off sealing membrane depicted there, showing the various elements of the closure assembled on a bottle as the elements would appear when the bottle is in the non-dispensing mode.

As shown in FIG. 3A, the lower rim or edge of the overcap skirt abuts a second annular ledge 19'. The overcap is held in position over the mouth of the bottle by an annular rim 23 around the inner periphery of the skirt 17' which snaps over, and engages beneath, a corresponding annular rim 23' around the outer periphery of the bottle neck and spaced above the second annular ledge 19'. Thus interengagement of annular rims 23/23' serves to lock the entire bottle/inner cap/conical valve/overcap assembly together.

Figure 3B:
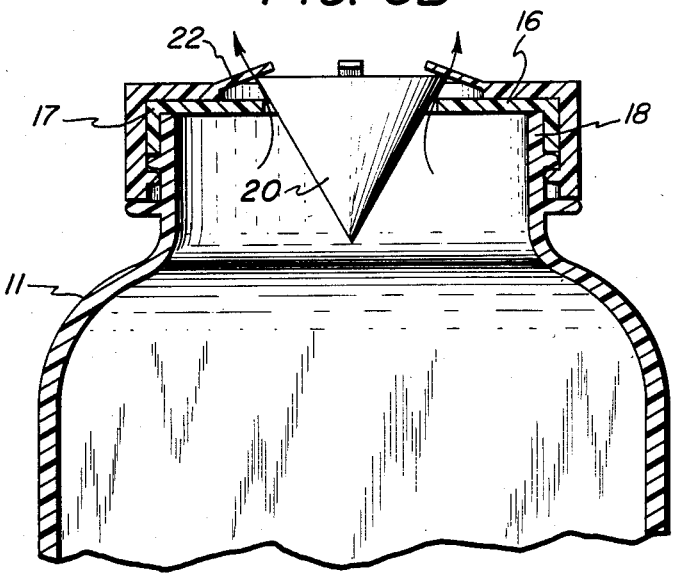
FIG. 3B is a cross section view on line III/III of FIG. 1, but lacking the peel-off sealing membrane depicted there, showing the various elements of the closure assembled on a bottle as the elements would appear when the bottle is in the dispensing mode.

The operation of the dispenser is best understood with reference to FIGS. 3A and 3B. When the bottle and dispensing closure elements are assembled and are in their non-dispensing mode, the elements appear as indicated in FIG. 3A. The interengagement of the overcap 12 with the bottle 11 is effected through cooperating and locking annular rims 23/23' around the inner periphery of the overcap skirt and the constricted portion of the bottle neck, respectively. It will also be seen that the flexible tabs 22 bear against the rim of the conical valve element 20, forcing it downwards, thus effecting sealing engagement between the outer wall of the valve near the base thereof and the edge of central opening 15.

When the flexible bottle is compressed, the various elements of the combination achieve the general relationship shown in FIG. 3B. That is, compression of the bottle forces air within the bottle out between the base of the conical valve and the edge of the central opening 15/15', as indicated by the arrows in FIG. 3B, the flexible tabs 22 being forced upward in the process. However when pressure on the bottle is released, the "memory" of the tabs causes them to return to their unflexed position, as indicated by the arrows in FIGS. 3A, thus forcing the valve to return to its original position and to again make sealing engagement with the edge of the central opening 15.

It will be understood that, although the preferred embodiments of the invention have been described above in order to better illustrate the same, alternative structural features can be substituted for elements described herein without either departing from the spirit of the invention or in any way adversely affecting the operability of the same. Thus, for example, although the inner cap is described as being a separate unit from the bottle, it will be appreciated that the invention would be fully operative if the inner cap and bottle are of unitary construction, the separation of these elements as here-described not being critical to the operation of the closure.

Furthermore, although the conical valve has been here-described as depending into the mouth of the bottle from the central opening of the inner cap, it will be readily apparent that the essential elements of the dispensing closure are the conical valve element and the flexible tabs which are unitary with the overcap, the conical valve and the flexible tabs cooperating with one another to permit expulsion of the container contents under pressure and to effect reclosure of the opening when the dispenser is not in use. Therefore any assembly of the conical valve element and the overcap with the unitary flexible tabs which will accomplish the essential cooperation between these elements is considered to be within the ambit of the invention. Thus it is contemplated, as an alternative, that the conical valve element can be suspended directly from the rim of the open mouth of a bottle. In such alternative embodiment, the bottle is fitted with an overcap having a very narrow top planar surface 16', the width of the planar surface essentially corresponding to the thickness of the wall of the bottle. Use of such assembly would thus obviate the need for the inner cap entirely.

Moreover the outer closure or overcap is heredescribed as being assembled to the bottle by interengagement of annular rims 23/23'. Such means of attachment is shown only for purposes of illustration, and any means of attaching a cap to a bottle, conventionally known in the prior art, such as screw-on engagement, solvent welding or heat sealing of the elements, is considered to be within the ambit of the invention.

The various elements of the bottle and closure units are advantageously made of plastic materials, such as polyethylene or polypropylene, and the particular choice of plastic for each of the elements will vary depending on the function performed by each element. Thus the bottle, which must be highly flexible and must have a good "memory", is preferably made of polypropylene, or high density polyethylene. The rim or edge of the central opening of the inner cap should preferably be relatively hard and able to hold a clean edge so as to effect good sealing with the conical valve which itself is preferably soft. Thus the inner cap is preferably made of polypropylene or high density polyethylene, while the conical valve is preferably made of low density polyethylene. The overcap, with the integral tabs, should desirably be flexible and should have a good "memory" and furthermore should also be sufficiently hard in order to provide a good exterior covering for the bottle. Thus polypropylene is suitable for the overcap.

Having thus described the invention and the advantages thereof, it is considered that the invention is to be broadly construed and limited only by the character of the following claims.

I claim:

1. A dispenser of the squeeze bottle type for dispensing dry powders which comprises:

A. a flexible bottle having an open mouth, to the mouth opening of which is attached:

B. a dispenser closure unit, said closure unit comprising:

i. a conical valve depending within the open mouth of said bottle; and ii. an integral one piece overcap attached to the mouth of said bottle, said overcap having a central opening therethrough, said overcap being provided with flexible tab retention means extending radially into said central opening for holding said conical valve in sealing engagement with the top opening of said dispenser and for permitting dispensing of the bottle contents from between said conical valve side wall and said central opening upon squeezing said bottle.

2. A dispenser according to claim 1 wherein said conical valve depends from the central opening of an inner cap.

3. A dispenser according to claim 2 wherein said inner cap abuts an annular ledge around the periphery of the neck of said bottle.

4. A dispenser according to claim 3 wherein said overcap fits over said inner cap and abuts a second annular ledge around the periphery of the neck of said bottle.

5. A dispenser according to claim 4 wherein said overcap is locked to the mouth of said bottle by interengagement of annular rims around the periphery of the outer wall of the neck of said bottle and the inner wall of a skirt of said overcap.

6. A dispenser according to claim 5 wherein the bottle is made of polypropylene, the inner cap is made of high density polyethylene, the over-cap is made of polypropylene and the conical valve is made of low density polyethylene.

7. A dispenser according to claim 6 wherein said overcap is sealed with a peel-off sealing membrane.

8. A dispenser according to claim 5 wherein the bottle is made of polypropylene, the inner cap is made of high density polypropylene, the overcap is made of polypropylene and the conical valve is made of low density polyethylene.

9. A dispenser according to claim 8 wherein said overcap is sealed with a peel-off sealable membrane.

10. A dispenser according to claim 4 wherein said overcap is attached to said bottle by screw-on engagement.

11. A dispenser according to claim 4 wherein said overcap is attached to said bottle by solvent welding.

12. A dispenser according to claim 4 wherein said overcap is attached to said bottle by heat sealing.

13. A dispenser according to claim 1 wherein said conical valve depends from the rim of the mouth of said bottle.

14. A dispenser according to claim 13 wherein said overcap fits over the mouth of said bottle and abuts an annular ledge around the periphery of the neck of said bottle.

15. A dispenser according to claim 14 wherein said overcap is locked to the mouth of said bottle by interengagement of annular rims around the periphery of the outer wall of the neck of said bottle and the inner wall of a skirt of said overcap.

16. A dispenser according to claim 14 wherein said overcap is attached to said bottle by screw-on engagement.

17. A dispenser according to claim 14 wherein said overcap is attached to said bottle by solvent welding.

18. A dispenser according to claim 14 wherein said overcap is attached to said bottle by heat sealing.

* * * * *